US008030385B2

(12) United States Patent
Comeau et al.

(10) Patent No.: US 8,030,385 B2
(45) **Date of Patent: *Oct. 4, 2011**

(54) GOLF BALL COMPOSITIONS

(75) Inventors: Brian Comeau, Berkley, MA (US); David A. Bulpett, Boston, MA (US); Douglas S. Goguen, New Bedford, MA (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 386 days.

This patent is subject to a terminal disclaimer.

(21) Appl. No.: 12/169,017

(22) Filed: Jul. 8, 2008

(65) Prior Publication Data

US 2008/0274834 A1 Nov. 6, 2008

Related U.S. Application Data

(63) Continuation-in-part of application No. 12/048,003, filed on Mar. 13, 2008, and a continuation-in-part of application No. 12/048,021, filed on Mar. 13, 2008, and a continuation-in-part of application No. 11/370,735, filed on Mar. 7, 2006, now Pat. No. 7,544,730.

(51) Int. Cl.
*A63B 37/06* (2006.01)
*A63B 37/00* (2006.01)
*C08L 9/00* (2006.01)

(52) U.S. Cl. ..... 524/345; 525/274; 473/374; 473/376

(58) Field of Classification Search ..... None
See application file for complete search history.

(56) References Cited

U.S. PATENT DOCUMENTS 4,974,852 A 12/1990 Hiraoka et al.
5,645,496 A * 7/1997 Endo et al. ..... 473/372
5,782,707 A 7/1998 Yamagishi et al.
6,193,920 B1 * 2/2001 Moriyama et al. ..... 264/250
6,339,119 B1 1/2002 Ladd et al.
6,488,597 B2 12/2002 Iwami et al.
6,575,850 B1 6/2003 Iwami et al.
6,608,127 B1 8/2003 Kato et al.
6,679,791 B2 1/2004 Watanabe
6,686,436 B2 2/2004 Iwami
6,750,281 B2 6/2004 Hirau et al.
6,767,940 B2 7/2004 Voorheis et al.
6,786,836 B2 9/2004 Higuchi et al.
6,864,315 B1 3/2005 Hakuta et al.
6,878,075 B2 4/2005 Kim
6,919,393 B2 7/2005 Mano et al.
6,956,128 B2 10/2005 Higuchi et al.
6,987,159 B2 1/2006 Iwami
7,086,969 B2 8/2006 Higuchi et al.
7,153,224 B2 12/2006 Higuchi et al.
7,160,207 B2 * 1/2007 Kennedy et al. ..... 473/374
7,175,542 B2 2/2007 Watanae et al.
7,226,367 B2 6/2007 Higuchi et al.
7,410,429 B1 * 8/2008 Bulpett et al. ..... 473/376
7,429,221 B1 * 9/2008 Bulpett et al. ..... 473/376
2002/0052253 A1 5/2002 Fushihara et al.
2003/0144425 A1 * 7/2003 Mano et al. ..... 525/261
2004/0033847 A1 * 2/2004 Higuchi et al. ..... 473/371
2004/0059062 A1 3/2004 Kim
2004/0152540 A1 8/2004 Fushihara
2004/0180733 A1 9/2004 Kim
2004/0214661 A1 10/2004 Sullivan et al.
2004/0219994 A1 11/2004 Sullivan
2004/0219995 A1 11/2004 Sullivan
2004/0242802 A1 12/2004 Voorheis et al.
2007/0213144 A1 9/2007 Comeau et al.
2007/0213440 A1 9/2007 Goguen et al.
2007/0213441 A1 9/2007 Comeau et al.
2007/0213442 A1 9/2007 Bulpett et al.
2009/0124416 A1 * 5/2009 Sullivan et al. ..... 473/373

* cited by examiner

*Primary Examiner* — David Buttner
(74) *Attorney, Agent, or Firm* — Mandi B. Milbank

(57) ABSTRACT

Golf balls comprising a core and a cover are disclosed. The core is a dual- or multi-layer core, wherein at least one layer is formed from a rubber composition comprising a base rubber and a catechol. The core layer formed from such rubber composition has a positive hardness gradient such that the difference between the layer's outer surface hardness and inner surface hardness is 5 Shore C units or greater.

14 Claims, No Drawings

GOLF BALL COMPOSITIONS

CROSS-REFERENCE TO RELATED APPLICATIONS

This application is a continuation-in-part of U.S. patent application Ser. No. 12/048,003, filed Mar. 13, 2008. This application is also a continuation-in-part of U.S. patent application Ser. No. 12/048,021, filed Mar. 13, 2008. This application is also a continuation-in-part of U.S. patent application Ser. No. 11/370,735, filed Mar. 7, 2006, now U.S. Pat. No. 7,544,730. The entire disclosure of each of these references is hereby incorporated herein by reference.

FIELD OF THE INVENTION

The present invention is directed to golf balls comprising a core and a cover. The core is a dual- or multi-layer core, wherein at least one layer is formed from a rubber composition comprising a base rubber and a catechol. The present invention is not limited by which core layer is formed from the catechol-containing rubber composition.

BACKGROUND OF THE INVENTION

The primary source of resilience, as measured by coefficient of restitution ("COR"), in commercially available golf balls is polybutadiene rubber, which is generally used to form all or part of the core. It is known that the resilience of a golf ball core, at a given compression, may be increased by forming a core layer from a rubber composition comprising an organosulfur compound. However, organosulfur compounds can be expensive and can cause processing difficulties.

Rubber compositions comprising catechols have been disclosed as useful in a variety of golf ball layers, including, for example, in U.S. Patent Application Publication No. 2007/0213144 to Comeau et al., the entire disclosure of which is hereby incorporated herein by reference.

While the use of catechols in rubber golf ball compositions has been disclosed, there is a need in the industry to broaden the applicability of such compositions to particular golf ball constructions having desirable spin, feel, and distance properties. The present invention provides such golf ball constructions through the use of a dual- or multi-layer core formed from a rubber composition comprising a base rubber and a catechol.

SUMMARY OF THE INVENTION

In one embodiment, the present invention is directed to a golf ball comprising a core and a cover. The core comprises an inner core layer and an outer core layer. The inner core layer is formed from a rubber composition comprising a base rubber and a catechol and has a positive hardness gradient wherein the difference between the Shore C hardness of the outer surface of the inner core layer ($H_{INNER\ CORE\ OUTER\ SURFACE}$) and the Shore C hardness of the center of the inner core layer ($H_{CENTER}$)$\geqq$5 Shore C units.

In another embodiment, the present invention is directed to a golf ball comprising a core and a cover. The core consists of an inner core layer and an outer core layer. The outer core layer is formed from a rubber composition comprising a base rubber and a catechol and has a positive hardness gradient wherein the difference between the Shore C hardness of the outer surface of the outer core layer ($H_{OUTER\ SURFACE}$) and the Shore C hardness of the inner surface of the outer core layer ($H_{OUTER\ CORE\ INNER\ SURFACE}$)$\geqq$5 Shore C units.

In yet another embodiment, the present invention is directed to a golf ball comprising a core and a cover. The core comprises an inner core layer, a first outer core layer, and a second outer core layer. At least one of the first and second outer core layers is formed from a rubber composition comprising a base rubber and a catechol and has a positive hardness gradient wherein the difference between the Shore C hardness of the outer surface of said outer core layer ($H_{OUTER\ SURFACE}$) and the Shore C hardness of the inner surface of said outer core layer ($H_{OUTER\ CORE\ INNER\ SURFACE}$) $\geqq$5 Shore C units.

DETAILED DESCRIPTION

Golf balls of the present invention have at least one layer formed from a catechol-containing rubber composition. More particularly, golf balls of the present invention include dual- and multi-layer cores enclosed by a cover, wherein at least one core layer is formed from a catechol-containing rubber composition. The present invention is not limited by which core layer is formed from a catechol-containing rubber composition. In golf balls having two or more layers comprising a catechol-containing rubber composition, the catechol-containing rubber composition of one layer may be the same as or different from that of another layer.

In golf balls of the present invention, the layer formed from the catechol-containing rubber composition preferably has a hardness gradient of 5 Shore C units or greater.

A hardness gradient of a golf ball layer is defined by hardness measurements made at the outer surface of the layer and the inner surface of the layer. The center hardness of the inner core layer and the outer surface of the outermost core layer of a golf ball are readily determined according to the procedures given herein for measuring the center hardness of a core and the outer surface hardness of a golf ball layer, respectively. The outer surface of the inner core layer and the outer surface of optional intermediate core layer(s) are readily determined according to the procedures given herein for measuring the outer surface hardness of a golf ball layer, if the measurement is made prior to surrounding the layer with an additional core layer. However, once an inner or intermediate core layer is surrounded by an additional core layer, the hardness of the outer surface of the inner or intermediate layer can be difficult to determine. Also, the inner surface hardness of any core layer other than the inner core layer can be difficult to determine. Thus, for purposes of the present invention:

- the center hardness of the inner core layer is measured according to the procedure below for measuring the center hardness of a core;
- the hardness of the outer surface of the inner core layer is measured:
  - prior to surrounding the inner core layer with another core layer, according to the procedure below for measuring the outer surface hardness of a golf ball layer;
  - after surrounding the inner core layer with another core layer, according to the procedure below for measuring a point located 1 mm from an interface;
- the hardness of the outer surface of the outermost core layer is measured according to the procedure below for measuring the outer surface hardness of a golf ball layer;
- the hardness of the inner surface of the outermost core layer is measured according to the procedure below for measuring a point located 1 mm from an interface;
- the hardness of the outer surface of any optional intermediate core layer(s) is measured:

prior to surrounding the intermediate core layer with another core layer, according to the procedure below for measuring the outer surface hardness of a golf ball layer;

after surrounding the intermediate core layer with another core layer, according to the procedure below for measuring a point located 1 mm from an interface;

the hardness of the inner surface of any optional intermediate core layer(s) is measured according to the procedure below for measuring a point located 1 mm from an interface.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within ±0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to insure that the golf ball or golf ball subassembly is centered under the durometer indentor before a surface hardness reading is obtained. A calibrated, digital durometer, capable of reading to 0.1 hardness units is used for all hardness measurements and is set to take hardness readings at 1 second after the maximum reading is obtained. The digital durometer must be attached to, and its foot made parallel to, the base of an automatic stand. The weight on the durometer and attack rate conform to ASTM D-2240.

The hardness of a golf ball layer at a point located 1 mm from an interface is obtained according to the following procedure. First, the geometric center of the core is revealed by preparing the core according to the above procedure for measuring the center hardness of a core. Leaving the core in the holder, a point located 1 mm radially inward or outward from the interface of two layers is determined and marked, and the hardness thereof is measured according to ASTM D-2240. When measuring the outer surface of a layer, the mark is made at a point located 1 mm radially inward from the interface at the outermost part of the layer. When measuring the inner surface of a layer, the mark is made at a point located 1 mm radially outward from the interface at the innermost part of the layer.

Hardness points should only be measured once at any particular geometric location.

For purposes of the present invention, "negative" and "positive" refer to the result of subtracting the hardness value at the innermost surface of the golf ball component from the hardness value at the outermost surface of the component. For example, if the outer surface of a solid core has a lower hardness value than the center (i.e., the surface is softer than the center), the hardness gradient will be deemed a "negative" gradient.

Hardness gradients are disclosed more fully, for example, in U.S. patent application Ser. Nos. 11/832,163, filed on Aug. 1, 2007; 11/939,632, filed on Nov. 14, 2007; 11/939,634, filed on Nov. 14, 2007; 11/939,635, filed on Nov. 14, 2007; and 11/939,637, filed on Nov. 14, 2007; the entire disclosure of each of these references is hereby incorporated herein by reference.

Golf ball cores with an overall steep hardness gradient (i.e., outer core surface harder than the center) are known. The overall steep hardness gradient in such cores is achieved by independently varying the center hardness and the outer core layer's surface hardness. The construction and material options in these previously known balls is limited, because poor durability resulted when the outer core layer reached a particular surface hardness and/or the difference in hardness between the outer core and the center was too high. The overall core compression in these previously known balls may also need to be excessively high in order to achieve the desired surface hardness.

By the present invention, it has been found that a core layer having a hardness gradient of 5 Shore C units or greater can be obtained through the use of a catechol-containing rubber composition. Dual- and multi-layer core golf balls having such a core layer can have a relatively high outer core surface hardness while maintaining a desirable overall core compression. Because the surface of the core can be made relatively hard, softer inner cover materials can be used to produce golf balls exhibiting relatively low driver spin while having desirable feel and iron spin. In some embodiments, the inner cover has a material hardness lower than the surface hardness of the outer core.

Rubber Composition

Rubber compositions of the present invention comprise a base rubber selected from natural and synthetic rubbers, including, but not limited to, polybutadiene, polyisoprene, ethylene propylene rubber ("EPR"), ethylene propylene diene rubber ("EPDM"), styrene-butadiene rubber, styrenic block copolymer rubbers (such as SI, SIS, SB, SBS, SIBS, and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof. Diene rubbers are preferred, particularly polybutadiene, styrene-butadiene, and mixtures of polybutadiene with other elastomers, and especially 1,4-polybutadiene having a cis-structure of at least 40%. When the base rubber is a mixture of polybutadiene and at least one additional rubber, the amount of polybutadiene in the mixture is preferably at least 40 wt %, based on the total weight of the mixture. Suitable examples of commercially available polybutadienes include, but are not limited to, Buna CB neodymium catalyzed polybutadiene rubbers, such as Buna CB 23, and Taktene® cobalt catalyzed polybutadiene rubbers, such as Taktene® 220 and 221, commercially available from LANXESS® Corporation; SE BR-1220, commercially available from The Dow Chemical Company; Europrene® NEOCIS® BR 40 and BR 60, commercially available from Polimeri Europa®; UBEPOL-BR® rubbers, commercially available from UBE Industries, Ltd.; BR 01 commercially available from Japan Synthetic Rubber Co., Ltd.; and Neodene neodymium catalyzed high cis polybutadiene rubbers, such as Neodene BR 40, commercially available from Karbochem.

Rubber compositions of the present invention include a catechol.

Preferred catechols include compounds represented by the following formula, and hydrates thereof:

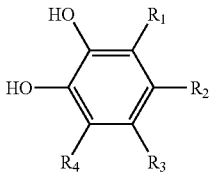

wherein each $R_1$, $R_2$, $R_3$, and $R_4$, is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$-phenyl); benzyl (—$CH_2$ phenyl)], a nitroso group (—NO), an acetamido group (—$NHCOCH_3$), and a vinyl group (—CH=$CH_2$).

Rubber compositions of the present invention may include a combination of two or more catechols, each of which is independently selected from compounds represented by the above formula, or a combination of at least one catechol and one or more chemical compounds selected from the group consisting of hydroquinones, benzoquinones, quinhydrones, and resorcinols.

The present invention is not limited by a particular method for adding the catechol to the rubber composition. The catechol can be added as part of a masterbatch or in the neat form as a liquid or solid.

The catechol is generally present in the rubber composition in an amount of at least 0.05 parts by weight or at least 0.1 parts by weight or at least 0.15 parts by weight or at least 0.2 parts by weight per 100 parts of the base rubber, or an amount within the range having a lower limit of 0.05 parts or 0.1 parts or 0.15 parts or 0.25 parts or 0.3 parts or 0.375 parts by weight per 100 parts of the base rubber, and an upper limit of 0.5 parts or 1 part or 1.5 parts or 2 parts or 3 parts by weight per 100 parts of the base rubber. In a particular embodiment, a ratio ($P_{CATECHOL}/P_{INITIATOR}$) of the amount of the catechol present in the rubber composition ($P_{CATECHOL}$) measured in parts by weight per 100 parts of the base rubber, to the amount of free radical initiator present in the rubber composition ($P_{INITIATOR}$), measured in parts by weight per 100 parts of the base rubber, is from 0.05 to 2. In another embodiment, $P_{CATECHOL}/P_{INITIATOR}$ is at least 0.05 and less than 0.5. In another embodiment, $P_{CATECHOL}/P_{INITIATOR}$ is at least 0.2 and less than 0.5. In another embodiment, $P_{CATECHOL}/P_{INITIATOR}$ is at least 0.25 and less than 0.5. In yet another embodiment, $P_{CATECHOL}/P_{INITIATOR}$ is within the range having a lower limit of 0.05 or 0.2 or 0.25 and an upper limit of 0.4 or 0.45 or 0.5 or 2.

Rubber compositions of the present invention preferably comprise a free radical initiator selected from organic peroxides, high energy radiation sources capable of generating free radicals, and combinations thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free radical initiators are generally present in the rubber composition in an amount of at least 0.05 parts by weight per 100 parts of the base rubber, or an amount within the range having a lower limit of 0.05 parts or 0.1 parts or 1 part or 1.25 parts or 1.5 parts by weight per 100 parts of the base rubber, and an upper limit of 2.5 parts or 3 parts or 5 parts or 6 parts or 10 parts or 15 parts by weight per 100 parts of the base rubber.

Coagents are commonly used with peroxides to increase the state of cure. Suitable coagents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, and nickel. In a particular embodiment, the coagent is selected from zinc salts of acrylates, diacrylates, methacrylates, and dimethacrylates. In another particular embodiment, the coagent is zinc diacrylate. When the coagent is zinc diacrylate and/or zinc dimethacrylate, the coagent is typically included in the rubber composition in an amount within the range having a lower limit of 1 or 5 or 10 or 15 or 19 or 20 parts by weight per 100 parts of the base rubber, and an upper limit of 24 or 25 or 30 or 35 or 40 or 45 or 50 or 60 parts by weight per 100 parts of the base rubber. When one or more less active coagents are used, such as zinc monomethacrylate and various liquid acrylates and methacrylates, the amount of less active coagent used may be the same as or higher than for zinc diacrylate and zinc dimethacrylate coagents. The desired compression may be obtained by adjusting the amount of crosslinking, which can be achieved, for example, by altering the type and amount of coagent.

Curing agents may also be used in rubber compositions of the present invention. Curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof.

High energy radiation sources capable of generating free radicals include, but are not limited to, electron beams, ultraviolet radiation, gamma radiation, X-ray radiation, infrared radiation, heat, and combinations thereof.

Rubber compositions of the present invention optionally contain one or more antioxidants. When antioxidants are included in the rubber composition, the amount of free radical initiator used may be as high or higher than the amounts disclosed herein. Suitable antioxidants include, for example, dihydroquinoline antioxidants, amine type antioxidants, and phenolic type antioxidants.

Rubber compositions of the present invention optionally contain one or more fillers to adjust the density and/or specific gravity of the core or cover. Exemplary fillers include, but are not limited to, precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), metal oxides (e.g., zinc oxide, iron oxide, aluminum oxide, titanium oxide, magnesium oxide, zirconium oxide, and tin oxide), particulate carbonaceous materials (e.g., graphite, carbon black, cotton flock, natural bitumen, cellulose flock, and leather fiber), microballoons (e.g., glass and ceramic), fly ash, regrind, nanofillers and combinations thereof. The amount of particulate material(s) present in rubber compositions of the present invention is typically within the range having a lower limit of 5 parts or 10 parts by weight per 100 parts of the base rubber, and an upper limit of 30 parts or 50 parts or 100 parts by weight per 100 parts of the base rubber.

Rubber compositions of the present invention optionally contain one or more additives selected from processing aids, processing oils, plasticizers, coloring agents, fluorescent agents, chemical blowing and foaming agents, defoaming agents, stabilizers, softening agents, impact modifiers, and the like. The amount of additive(s) typically present in rubber compositions of the present invention is typically within the range having a lower limit of 0 parts by weight per 100 parts of the base rubber and an upper limit of 20 parts or 50 parts or 100 parts or 150 parts by weight per 100 parts of the base rubber.

In one embodiment of the present invention, the rubber composition contains a conventional soft and fast agent. The conventional soft and fast agent is optionally used in an amount within a range having a lower limit of 0.1 or 0.2 or 0.5 phr and an upper limit of 2 or 3 or 5 phr. As used herein, "soft and fast agent" means any compound or a blend thereof that is capable of making a core 1) softer (have a lower compression) at a constant COR and/or 2) faster (have a higher COR at equal compression), when compared to a core equivalently prepared without a soft and fast agent. Suitable conventional soft and fast agents include, but are not limited to, those selected from organosulfur and metal-containing organosulfur compounds, organic sulfur compounds, including mono, di, and polysulfides, thiol, and mercapto compounds, inorganic sulfide compounds, Group VIA compounds, substituted or unsubstituted aromatic organic compounds that do not contain sulfur or metal, aromatic organometallic compounds, and mixtures thereof. Particularly suitable soft and fast agents include, but are not limited to, zinc pentachlorothiophenol, pentachlorothiophenol, ditolyl disulfide, diphenyl disulfide, dixylyl disulfide, and mixtures thereof. The soft and fast agent component may also be a blend of an organosulfur compound and an inorganic sulfide compound. Suitable organosulfur compounds are further disclosed, for example, in U.S. Pat. Nos. 6,635,716, 6,919,393, 7,005,479 and 7,148,279, the entire disclosures of which are hereby incorporated herein by reference.

In another embodiment, the rubber composition is substantially free of organosulfur compounds. "Substantially free," as used herein, means that the rubber composition does not contain an organosulfur compound, or includes one or more organosulfur compounds in an amount of less than 0.01 parts by weight per 100 parts of the base rubber.

Suitable types and amounts of rubber, initiator, coagent, curing agent, antioxidant, filler, and additive are more fully disclosed, for example, in U.S. Pat. Nos. 6,566,483, 6,695,718, 6,939,907, 7,041,721 and 7,138,460, the entire disclosures of which are hereby incorporated herein by reference.

Golf Ball Applications

Golf balls of the present invention include golf balls having a dual- or multi-layer core enclosed by a cover, wherein at least one core layer is formed from a catechol-containing rubber composition, as disclosed above. Core layers not formed from a catechol-containing rubber composition are preferably formed from suitable golf ball core compositions including, but not limited to conventional rubber and HNP golf ball compositions.

In one embodiment, the present invention provides a golf ball having a dual-layer core, wherein the core includes an inner core layer and an outer core layer. In a particular aspect of this embodiment, the inner core layer is formed from a catechol-containing rubber composition. In another particular aspect of this embodiment, the outer core layer is formed from a catechol-containing rubber composition.

In another embodiment, the present invention provides a golf ball having a multi-layer core, wherein the core includes an inner core layer, a first outer core layer, and a second outer core layer. In a particular aspect of this embodiment, the inner core layer is formed from a catechol-containing rubber composition. In another particular aspect of this embodiment, the first outer core layer is formed from a catechol-containing rubber composition. In yet another particular aspect of this embodiment, the second outer core layer is formed from a catechol-containing rubber composition.

The core layer formed from the catechol-containing rubber composition preferably has a positive hardness gradient wherein the difference between the Shore C hardness of the outer surface of the layer and the Shore C hardness of the inner surface of the layer (i.e., the center of the inner core layer or the inner surface of the outer core layer) is 10 Shore C units or greater, or 15 Shore C units or greater, or 20 Shore C units or greater, or 25 Shore C units or greater, or 30 Shore C units or greater, or 35 Shore C units or greater, or 40 Shore C units or greater, or 45 Shore C units or greater.

Golf ball cores of the present invention generally have an overall diameter within a range having a lower limit of 1.00 or 1.25 or 1.40 or 1.45 or 1.50 or 1.51 or 1.52 or 1.53 inches and an upper limit of 1.54 or 1.55 or 1.56 or 1.57 or 1.58 or 1.59 or 1.60 or 1.62 or 1.63 or 1.66 inches. In a particularly preferred embodiment, the core has a diameter of about 1.53 inches.

The inner core layer of dual- and multi-layer cores of the present invention generally has a diameter within a range having a lower limit of 0.500 or 0.750 or 1.000 or 1.100 or 1.200 inches and an upper limit of 1.300 or 1.350 or 1.400 or 1.550 or 1.570 or 1.580 inches, or a diameter within a range having a lower limit of 0.750 or 0.850 or 0.875 inches and an upper limit of 1.125 or 1.150 or 1.190 inches.

The Shore C hardness of the center of the inner core layer ($H_{CENTER}$) is preferably 45 Shore C or greater, or 50 Shore C or greater, or 55 Shore C or greater, or 60 Shore C or greater, or within a range having a lower limit of 30 or 40 or 45 or 50 or 55 or 60 Shore C and an upper limit of 65 or 70 or 75 or 80 Shore C.

The Shore C hardness of the outer surface of the inner core layer ($H_{INNER\ CORE\ OUTER\ SURFACE}$) is preferably 65 Shore C or greater, or 70 Shore C or greater, or 75 Shore C or greater, or 80 Shore C or greater, or 85 Shore C or greater, or 90 Shore C or greater, or within a range having a lower limit of 55 or 60 or 65 or 70 or 75 Shore C and an upper limit of 80 or 85 or 90 or 95 Shore C. In a particular embodiment, the inner core layer is formed from a catechol-containing rubber composition, as disclosed herein, and the hardness of the outer surface of the inner core layer ($H_{INNER\ CORE\ OUTER\ SURFACE}$) is preferably within a range having a lower limit of 55 or 60 or 65 or 70 or 75 Shore C and an upper limit of 80 or 85 or 90 or 95 Shore C or 60 Shore D or 65 Shore D or 70 Shore D.

The outer core layer(s) of dual- and multi-layer cores of the present invention generally have a thickness within a range having a lower limit of 0.020 or 0.025 or 0.032 inches and an upper limit of 0.310 or 0.440 or 0.560 inches. The Shore C hardness of the outer surface of the outer core layer ($H_{OUTER\ SURFACE}$) is preferably 75 Shore C or greater, or 80 Shore C or greater, or greater than 80 Shore C, or 85 Shore C or greater, or greater than 85 Shore C, or 87 Shore C or greater, or greater than 87 Shore C, or 89 Shore C or greater, or greater than 89 Shore C, or 90 Shore C or greater, or greater than 90 Shore C, or within a range having a lower limit of 75 or 80 or 85 Shore C and an upper limit of 95 Shore C. In a particular embodiment, the outer core layer has a surface hardness greater than or equal to the surface hardness and center hardness of the inner core layer. In another particular embodiment, the outer core layer is formed from a catechol-containing rubber composition, as disclosed herein, and the hardness of the outer surface of the outer core layer ($H_{OUTER\ SURFACE}$) is preferably within a range having a lower limit of 75 or 80 or 85 Shore C and an upper limit of 95 Shore C or 60 Shore D or 65 Shore D or 70 Shore D.

The weight distribution of cores disclosed herein can be varied to achieve certain desired parameters, such as spin rate, compression, and initial velocity.

The inner core layer preferably has a compression of 20 or less. Golf ball cores of the present invention preferably have an overall compression within a range having a lower limit of 40 or 50 or 60 or 65 or 70 or 75 and an upper limit of 80 or 85 or 90 or 100 or 110 or 120, or an overall compression of about 90.

Compression is an important factor in golf ball design. For example, the compression of the core can affect the ball's spin rate off the driver and the feel. As disclosed in Jeff Dalton's *Compression by Any Other Name, Science and Golf IV, Proceedings of the World Scientific Congress of Golf* (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

Golf ball cores of the present invention typically have a coefficient of restitution ("COR") at 125 ft/s of at least 0.750, or at least 0.775 or at least 0.780, or at least 0.782, or at least 0.785, or at least 0.787, or at least 0.790, or at least 0.795, or at least 0.798, or at least 0.800.

COR, as used herein, is determined according to a known procedure wherein a golf ball or golf ball subassembly (e.g., a golf ball core) is fired from an air cannon at two given velocities and calculated at a velocity of 125 ft/s. Ballistic light screens are located between the air cannon and the steel plate at a fixed distance to measure ball velocity. As the ball travels toward the steel plate, it activates each light screen, and the time at each light screen is measured. This provides an incoming transit time period inversely proportional to the ball's incoming velocity. The ball impacts the steel plate and rebounds though the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$.

Cores of the present invention are enclosed with a cover, which may be a single-, dual-, or multi-layer cover, preferably having an overall thickness within the range having a lower limit of 0.01 inches or 0.02 inches or 0.025 inches or 0.03 inches or 0.04 inches or 0.045 inches or 0.05 inches or 0.06 inches and an upper limit of 0.07 inches or 0.075 inches or 0.08 inches or 0.09 inches or 0.1 inches or 0.15 inches or 0.2 inches or 0.3 inches or 0.5 inches. Dual and multilayer covers have an inner cover layer and an outer cover layer, and multilayer covers additionally have at least one intermediate cover layer disposed between the inner cover layer and the outer cover layer. Inner cover layers of the present invention preferably have a thickness within the range having a lower limit of 0.010 or 0.015 or 0.020 or 0.025 or 0.030 inches and an upper limit of 0.035 or 0.045 or 0.050 or 0.080 or 0.120 or 0.150 or 0.200 inches. Outer cover layers of the present invention preferably have a thickness of 0.010 or 0.015 or 0.020 or 0.025 inches and an upper limit of 0.035 or 0.040 or 0.050 or 0.055 or 0.080 or 0.150 or 0.200 inches. Intermediate cover layer(s) of the present invention preferably have a thickness of 0.010 or 0.020 or 0.0250 inches and an upper limit of 0.050 or 0.150 or 0.200 inches.

The cover material is preferably a tough, cut-resistant material, selected based on the desired performance characteristics. Suitable cover materials for the golf balls disclosed herein include, but are not limited to, ionomer resins and blends thereof (e.g., Surlyn® ionomer resins and DuPont® HPF 1000 and HPF 2000, commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof, polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof. Suitable cover materials and constructions also include, but are not limited to, those disclosed in U.S. Pat. Nos. 6,117,025, 6,767,940, and 6,960,630, the entire disclosures of which are hereby incorporated herein by reference.

Compositions comprising an ionomer or a blend of two or more ionomers are particularly suitable for forming the inner cover layer in dual-layer covers. Preferred ionomeric compositions include:

(a) a composition comprising a "high acid ionomer" (i.e., having an acid content of greater than 16 wt %), such as Surlyn 8150®;

(b) a composition comprising a high acid Ionomer and a maleic anhydride-grafted non-ionomeric polymer (e.g., Fusabond® maleic anhydride-grafted metallocene-catalyzed ethylene-butene copolymers). A particularly preferred blend of high acid ionomer and maleic anhydride-grafted polymer is a 84 wt %/16 wt % blend of Surlyn 8150® and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;

(c) a composition comprising a 50/45/5 blend of Surlyn® 8940/Surlyn® 9650/Nucrel® 960, preferably having a material hardness of from 80 to 85 Shore C;

(d) a composition comprising a 50/25/25 blend of Surlyn® 8940/Surlyn® 9650/Surlyn® 9910, preferably having a material hardness of about 90 Shore C;

(e) a composition comprising a 50/50 blend of Surlyn® 8940/Surlyn® 9650, preferably having a material hardness of about 86 Shore C;

(f) a composition comprising a blend of Surlyn® 7940/Surlyn® 8940, optionally including a melt flow modifier;

(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9150), optionally including one or more melt flow modifiers such as an ionomer, ethylene-acid copolymer or ester terpolymer; and (h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140, 40-50 wt % Surlyn® 9120, and 0-10 wt % Surlyn® 6320).

Surlyn 8150®, Surlyn® 8940, and Surlyn® 8140 are different grades of E/MAA copolymer in which the acid groups have been partially neutralized with sodium ions. Surlyn® 9650, Surlyn® 9910, Surlyn® 9150, and Surlyn® 9120 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Surlyn® ionomers, Fusabond® copolymers, and Nucrel® copolymers are commercially available from E. I. du Pont de Nemours and Company.

Non-limiting examples of particularly preferred ionomeric cover layer formulations are shown in Table 1 below.

TABLE 1

| Cover Layer Material | Surlyn ® 8150, wt % | Fusabond ®, wt % | Shore C Hardness at 10 Days |
|---|---|---|---|
| 1 | 89 | 11 | 91.2 |
| 2 | 84 | 16 | 89.8 |
| 3 | 84 | 16 | 90.4 |
| 4 | 84 | 16 | 89.6 |
| 5 | 81 | 19 | 88.9 |
| 6 | 80 | 20 | 89.1 |
| 7 | 78 | 22 | 88.1 |
| 8 | 76 | 24 | 87.6 |
| 9 | 76 | 24 | 87.2 |
| 10 | 73 | 27 | 86.6 |
| 11 | 71 | 29 | 86.7 |
| 12 | 67 | 33 | 84.0 |

Ionomeric cover compositions can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, plyethylene-(meth)acrylic acid, functionalized polymers with maleic anhydride grafting, Fusabond® functionalized olefins commercially available from E. I. du Pont de Nemours and Company, functionalized polymers with epoxidation, elastomers (e.g., ethylene propylene diene monomer rubber, metallocene-catalyzed polyolefin) and ground powders of thermoset elastomers.

Suitable ionomeric cover materials are further disclosed, for example, in U.S. Pat. Nos. 6,653,382, 6,756,436, 6,894,098, 6,919,393, and 6,953,820, the entire disclosures of which are hereby incorporated by reference.

Polyurethanes, polyureas, and blends and hybrids of polyurethane/polyurea are particularly suitable for forming the outer cover layer in dual-layer covers. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques. In embodiments of the present invention wherein a golf ball having a single layer cover is provided, the cover layer material is preferably selected from polyurethane and polyurea. In embodiments of the present invention wherein a golf ball having a dual cover is provided, the inner cover layer is preferably a high modulus thermoplastic, and the outer cover layer is preferably selected from polyurethane and polyurea.

Suitable polyurethane cover materials are further disclosed in U.S. Pat. Nos. 5,334,673, 6,506,851, 6,756,436, and 7,105,623, the entire disclosures of which are hereby incorporated herein by reference. Suitable polyurea cover materials are further disclosed in U.S. Pat. Nos. 5,484,870 and 6,835,794, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

Golf ball cover compositions may include a flow modifier, such as, but not limited to, Nucrel® acid copolymer resins, and particularly Nucrel® 960. Nucrel® acid copolymer resins are commercially available from E. I. du Pont de Nemours and Company.

Cover compositions may also include one or more filler(s), such as the fillers given above for rubber compositions of the present invention (e.g., titanium dioxide, barium sulfate, etc.), and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Additional suitable cover materials are disclosed, for example, in U.S. Patent Application Publication No. 2005/0164810, U.S. Pat. No. 5,919,100, and PCT Publications WO00/23519 and WO00/29129, the entire disclosures of which are hereby incorporated herein by reference.

In a particular embodiment, the cover is a single layer preferably formed from an ionomeric composition. The single layer cover preferably has a surface hardness of 65 Shore D or less, or 60 Shore D or less, or 45 Shore D or less, or 40 Shore D or less, or from 25 Shore D to 40 Shore D, or from 30 Shore D to 40 Shore D and a thickness within a range having a lower limit of 0.010 or 0.015 or 0.020 or 0.025 or 0.030 or 0.055 or 0.060 inches and an upper limit of 0.065 or 0.080 or 0.090 or 0.100 or 0.110 or 0.120 or 0.140 inches.

In another particular embodiment, the cover is a two-layer cover consisting of an inner cover layer and an outer cover layer. In a particular aspect of this embodiment, the surface hardness of the core is greater than the material hardness of the inner cover layer. In another particular aspect of this embodiment, the surface hardness of the core is greater than the material hardness of both the inner cover layer and the outer cover layer.

The inner cover layer is preferably formed from an ionomeric composition and preferably has a surface hardness of 60 Shore D or greater, or 65 Shore D or greater, or a surface hardness within a range having a lower limit of 30 or 40 or 55 or 60 or 65 Shore D and an upper limit of 66 or 68 or 70 or 75 Shore D, and a thickness within a range having a lower limit of 0.010 or 0.015 or 0.020 or 0.030 inches and an upper limit of 0.035 or 0.040 or 0.045 or 0.050 or 0.055 or 0.075 or 0.080 or 0.100 or 0.110 or 0.120 inches. The inner cover layer composition preferably has a material hardness of 95 Shore C or less, or less than 95 Shore C, or 92 Shore C or less, or 90 Shore C or less, or 85 Shore C or less, or has a material hardness within a range having a lower limit of 70 or 75 or 80 or 82 or 84 Shore C and an upper limit of 85 or 86 or 90 or 92 or 95 Shore C. The outer cover layer is preferably formed from a castable or reaction injection moldable polyurethane, polyurea, or copolymer or hybrid of polyurethane/polyurea. Such cover material is preferably thermosetting, but may be thermoplastic. The outer cover layer composition preferably has a material hardness of 85 Shore C or less, or 45 Shore D or less, or 40 Shore D or less, or from 25 Shore D to 40 Shore D, or from 30 Shore D to 40 Shore D. The outer cover layer preferably has a surface hardness within a range having a lower limit of 20 or 30 or 35 or 40 Shore D and an upper limit of 52 or 58 or 60 or 65 or 70 or 72 or 75 Shore D. The outer cover layer preferably has a thickness within a range having a lower limit of 0.010 or 0.015 or 0.025 inches and an upper limit of 0.035 or 0.040 or 0.045 or 0.050 or 0.055 or 0.075 or 0.080 or 0.115 inches. The two-layer cover preferably has an overall thickness within a range having a lower limit of 0.010 or 0.015 or 0.020 or 0.025 or 0.030 or 0.055 or 0.060 inches and an upper limit of 0.065 or 0.075 or 0.080 or 0.090 or 0.100 or 0.110 or 0.120 or 0.140 inches.

For purposes of the present disclosure, material hardness is measured according to ASTM D2240 and generally involves measuring the hardness of a flat "slab" or "button" formed of the material. It should be understood that there is a fundamental difference between "material hardness" and "hardness as measured directly on a golf ball." Hardness as measured directly on a golf ball (or other spherical surface) typically results in a different hardness value than material hardness. This difference in hardness values is due to several factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other. Unless stated otherwise, the hardness values given herein for cover materials are material hardness values measured according to ASTM D2240, with all values reported following 10 days of aging at 50% relative humidity and 23° C.

Golf balls of the present invention optionally include one or more intermediate layer(s) disposed between the core and the cover. When present, the overall thickness of the intermediate layer(s) is generally within the range having a lower limit of 0.01 inches or 0.05 inches or 0.1 inches and an upper limit of 0.3 inches or 0.35 inches or 0.4 inches. Suitable intermediate layer materials include, but are not limited to, natural rubbers, balata, gutta-percha, cis-polybutadienes, trans-polybutadienes, synthetic polyisoprenes, polyoctenamers, styrene-propylene-diene rubbers, metallocene rubbers, styrene-butadiene rubbers, ethylene-propylenes, chloroprene rubbers, acrylonitrile rubbers, acrylonitrile-butadiene rubbers, styrene-ethylene block copolymers, maleic anhydride or succinate modified metallocene catalyzed ethylene copolymers, polypropylene resins, ionomer resins, polyamides, polyesters, polyurethanes, polyureas, chlorinated polyethylenes, polysulfide rubbers, fluorocarbons, and combinations thereof.

A moisture vapor barrier layer is optionally employed between the core and the cover. Moisture vapor barrier layers are further disclosed, for example, in U.S. Pat. Nos. 6,632,147, 6,932,720, 7,004,854, and 7,182,702, the entire disclosures of which are hereby incorporated herein by reference.

Golf balls of the present invention preferably have an overall diameter within the range having a lower limit of 1.60 or 1.62 or 1.66 inches and an upper limit of 1.69 or 1.74 or 1.80 inches. More preferably, golf balls of the present invention have an overall diameter of 1.68 inches. Golf balls of the present invention typically have a compression of 120 or less, or a compression within a range having a lower limit of 40 or 50 or 60 or 65 or 75 or 80 or 90 and an upper limit of 95 or 100 or 105 or 110 or 115 or 120. Golf balls of the present invention preferably have a COR at 125 ft/s of 0.700 or greater, or 0.750 or greater, or 0.780 or greater, or 0.790 or greater.

Golf balls of the present invention will typically have dimple coverage of 60% or greater, preferably 65% or greater, and more preferably 75% or greater.

The United States Golf Association specifications limit the minimum size of a competition golf ball to 1.680 inches. There is no specification as to the maximum diameter, and golf balls of any size can be used for recreational play. Golf balls of the present invention can have an overall diameter of any size. The preferred diameter of the present golf balls is from 1.680 inches to 1.800 inches. More preferably, the present golf balls have an overall diameter of from 1.680 inches to 1.760 inches, and even more preferably from 1.680 inches to 1.740 inches.

Golf balls of the present invention preferably have a moment of inertia ("MOI") of 70-95 $g \cdot cm^2$, preferably 75-93 $g \cdot cm^2$, and more preferably 76-90 $g \cdot cm^2$. For low MOI embodiments, the golf ball preferably has an MOI of 85 $g \cdot cm^2$ or less, or 83 $g \cdot cm^2$ or less. For high MOI embodiment, the golf ball preferably has an MOI of 86 $g \cdot cm^2$ or greater, or 87 $g \cdot cm^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

Suitable golf ball constructions and materials are further disclosed, for example, in U.S. Patent Application Publication Nos. 2003/0144087 and 2005/0164810, U.S. Pat. Nos. 5,688,119 and 5,919,100, and PCT Publications WO00/23519 and WO00/29129. The entire disclosure of each of these references is hereby incorporated herein by reference.

The present invention is not limited by any particular process for forming the golf ball layer(s). It should be understood that the layer(s) can be formed by any suitable technique, including injection molding, compression molding, casting, and reaction injection molding.

When injection molding is used, the composition is typically in a pelletized or granulated form that can be easily fed into the throat of an injection molding machine wherein it is melted and conveyed via a screw in a heated barrel at temperatures of from 150° F. to 600° F., preferably from 200° F. to 500° F. The molten composition is ultimately injected into a closed mold cavity, which may be cooled, at ambient or at an elevated temperature, but typically the mold is cooled to a temperature of from 50° F. to 70° F. After residing in the closed mold for a time of from 1 second to 300 seconds, preferably from 20 seconds to 120 seconds, the core and/or core plus one or more additional core or cover layers is removed from the mold and either allowed to cool at ambient or reduced temperatures or is placed in a cooling fluid such as water, ice water, dry ice in a solvent, or the like.

When compression molding is used to form a core, the composition is first formed into a preform or slug of material, typically in a cylindrical or roughly spherical shape at a weight slightly greater than the desired weight of the molded core. Prior to this step, the composition may be first extruded or otherwise melted and forced through a die after which it is cut into a cylindrical preform. It is that preform that is then placed into a compression mold cavity and compressed at a mold temperature of from 150° F. to 400° F., preferably from 250° F. to 400° F., and more preferably from 300° F. to 400° F. When compression molding a cover layer, half-shells of the cover layer material are first formed via injection molding. A core is then enclosed within two half shells, which is then placed into a compression mold cavity and compressed.

Reaction injection molding processes are further disclosed, for example, in U.S. Pat. Nos. 6,083,119, 7,338,391, 7,282,169, 7,281,997 and U.S. Patent Application Publication No. 2006/0247073, the entire disclosures of which are hereby incorporated herein by reference.

Thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. Nos. 12/048,665, filed on Mar. 14, 2008; 11/829,461, filed on Jul. 27, 2007; 11/772,903, filed Jul. 3, 2007; 11/832,163, filed Aug. 1, 2007; 11/832,197, filed on Aug. 1, 2007; the entire disclosure of each of these references is hereby incorporated herein by reference.

In embodiments of the present invention wherein at least one layer is formed from a conventional rubber composition, suitable rubber compositions include natural and synthetic rubbers, including, but not limited to, polybutadiene, polyisoprene, ethylene propylene rubber ("EPR"), ethylene propylene diene rubber ("EPDM"), styrenic block copolymer rubbers (such as SI, SIS, SB, SBS, SIBS, and the like, where "S" is styrene, "I" is isobutylene, and "B" is butadiene), butyl rubber, halobutyl rubber, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof. Diene rubbers are preferred, particularly polybutadienes and mixtures of polybutadiene with other elastomers, and especially 1,4-polybutadiene having a cis-structure of at least 40%. In a particularly preferred embodiment, the rubber composition is a reaction product of a diene rubber, a crosslinking agent, a filler, a co-crosslinking agent or free radical initiator, and optionally a cis-to-trans catalyst. The rubber is preferably selected from polybutadiene and styrene-butadiene. The crosslinking agent typically includes a metal salt, such as a zinc-, aluminum-, sodium-, lithium-, nickel-, calcium-, or magnesium salt, of an unsaturated fatty acid or monocarboxylic acid, such as (meth) acrylic acid. Preferred crosslinking agents include zinc acrylate, zinc diacrylate (ZDA), zinc methacrylate, and zinc dimethacrylate (ZDMA), and mixtures thereof. The crosslinking agent is present in an amount sufficient to crosslink a portion of the chains of the polymers in the composition. The crosslinking agent is generally present in the rubber composition in an amount of from 15 to 30 phr, or from 19 to 25 phr, or from 20 to 24 phr. The desired compression may be obtained by adjusting the amount of crosslinking, which can be achieved, for example, by altering the type and amount of crosslinking agent. The free radical initiator can be any known polymerization initiator which decomposes during the cure cycle, including, but not limited to, dicumyl peroxide, 1,1-di-(t-butylperoxy) 3,3,5-trimethyl cyclohexane, a-a bis-(t-butylperoxy) diisopropylbenzene, 2,5-dimethyl-2,5 di-(t-butylperoxy) hexane or di-t-butyl peroxide, and mixtures thereof. The rubber composition optionally contains one or more antioxidants. Antioxidants are compounds that can inhibit or prevent the oxidative degradation of the rubber. Suitable antioxidants include, for example, dihydroquinoline antioxidants, amine type antioxidants, and phenolic type antioxidants. The rubber composition may also contain one or more fillers to adjust the density and/or specific gravity of the core or cover. Fillers are typically polymeric or mineral particles. Exemplary fillers include precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates (e.g., calcium carbonate and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), metal oxides (e.g., zinc oxide, iron oxide, aluminum oxide, titanium oxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, regrind, nanofillers and combinations thereof. The rubber composition may also contain one or more additives selected from free radical scavengers, accelerators, scorch retarders, coloring agents, fluorescent agents, chemical blowing and foaming agents, defoaming agents, stabilizers, softening agents, impact modifiers, plasticizers, and the like. The rubber composition may also contain a soft and fast agent, such as those disclosed in U.S. patent application Ser. No. 11/972,240, the entire disclosure of which is hereby incorporated herein by reference. Examples of commercially available polybutadienes suitable for use in forming golf ball core layers of the present invention include, but are not limited to, Buna CB23, commercially available from LANXESS Corporation; SE BR-1220, commercially available from The Dow Chemical Company; Europrene® NEOCIS® A BR 40 and BR 60, commercially available from Polimeri Europa; UBEPOL-BR® rubbers, commercially available from UBE Industries, Ltd.; and BR 01 commercially available from Japan Synthetic Rubber Co., Ltd. Suitable types and amounts of rubber, crosslinking agent, filler, co-crosslinking agent, initiator and additives are more fully described in, for example, U.S. Patent Application Publication No. 2004/0214661, 2003/0144087, and 2003/0225197, and U.S. Pat. Nos. 6,566,483, 6,695,718, and 6,939,907, the entire disclosures of which are hereby incorporated herein by reference.

In embodiments of the present invention wherein at least one layer is formed from an HNP composition, suitable HNP compositions comprise an HNP and optionally additives, fillers, and/or melt flow modifiers. Suitable HNPs are salts of copolymers of α,β-ethylenically unsaturated mono- or dicarboxylic acids, and combinations thereof, optionally including a softening monomer. The acid polymer is neutralized to 70% or higher, including up to 100%, with a suitable cation source. Suitable additives and fillers include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants; inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., core material that is ground and recycled; and nano-fillers. Suitable melt flow modifiers include, for example, fatty acids and salts thereof, polyamides, polyesters, polyacrylates, polyurethanes, polyethers, polyureas, polyhydric alcohols, and combinations thereof. Suitable HNP compositions also include blends of HNPs with partially neutralized ionomers as disclosed, for example, in U.S. Patent Application Publication No. 2006/0128904, the entire disclosure of which is hereby incorporated herein by reference, and blends of HNPs with additional thermoplastic and thermoset materials, including, but not limited to, ionomers, acid copolymers, engineering thermoplastics, fatty acid/salt-based highly neutralized polymers, polybutadienes, polyurethanes, polyesters, thermoplastic elastomers, and other conventional polymeric materials. Suitable HNP compositions are further disclosed, for example, in U.S. Pat. Nos. 6,653,382, 6,756,436, 6,777,472, 6,894,098, 6,919,393, and 6,953,820, the entire disclosures of which are hereby incorporated herein by reference.

In addition to the materials disclosed above, any of the core or cover layers may comprise one or more of the following materials: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyester-amides, polyether-amides, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene-catalyzed polymers, styrene-acrylonitrile (SAN), olefin-modified SAN, acrylonitrile-styrene-acrylonitrile, styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene rubber (EPDM), ethylene-vinyl acetate copolymer (EVA), ethylene propylene rubber (EPR), ethylene vinyl acetate, polyurea, and polysiloxane. Suitable polyamides for use as an additional material in compositions disclosed herein also include resins obtained by: (1) polycondensation of (a) a dicarboxylic acid, such as oxalic acid, adipic acid, sebacic acid, terephthalic acid, isophthalic acid or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexyldiamine or m-xylylenediamine; (2) a ring-opening polymerization of cyclic lactam, such as 8-caprolactam or ω-laurolactam; (3)

polycondensation of an aminocarboxylic acid, such as 6-aminocaproic acid, 9-aminononanoic acid, 11-aminoundecanoic acid or 12-aminododecanoic acid; or (4) copolymerzation of a cyclic lactam with a dicarboxylic acid and a diamine. Specific examples of suitable polyamides include Nylon 6, Nylon 66, Nylon 610, Nylon 11, Nylon 12, copolymerized Nylon, Nylon MXD6, and Nylon 46.

Other preferred materials suitable for use as an additional material in golf ball compositions disclosed herein include Skypel polyester elastomers, commercially available from SK Chemicals of South Korea; Septon® diblock and triblock copolymers, commercially available from Kuraray Corporation of Kurashiki, Japan; and Kraton® diblock and triblock copolymers, commercially available from Kraton Polymers LLC of Houston, Tex.

Ionomers are also well suited for blending with compositions disclosed herein. Suitable ionomeric polymers include α-olefin/unsaturated carboxylic acid copolymer- or terpolymer-type ionomeric resins. Copolymeric ionomers are obtained by neutralizing at least a portion of the carboxylic groups in a copolymer of an α-olefin and an α,β-unsaturated carboxylic acid having from 3 to 8 carbon atoms, with a metal ion. Terpolymeric ionomers are obtained by neutralizing at least a portion of the carboxylic groups in a terpolymer of an α-olefin, an α,β-unsaturated carboxylic acid having from 3 to 8 carbon atoms, and an α,β-unsaturated carboxylate having from 2 to 22 carbon atoms, with a metal ion. Examples of suitable α-olefins for copolymeric and terpolymeric ionomers include ethylene, propylene, 1-butene, and 1-hexene. Examples of suitable unsaturated carboxylic acids for copolymeric and terpolymeric ionomers include acrylic, methacrylic, ethacrylic, α-chloroacrylic, crotonic, maleic, fumaric, and itaconic acid. Copolymeric and terpolymeric ionomers include ionomers having varied acid contents and degrees of acid neutralization, neutralized by monovalent or bivalent cations as disclosed herein. Examples of commercially available ionomers suitable for blending with compositions disclosed herein include Surlyn® ionomer resins, commercially available from E. I. du Pont de Nemours and Company, and Iotek® ionomers, commercially available from ExxonMobil Chemical Company.

Silicone materials are also well suited for blending with compositions disclosed herein. Suitable silicone materials include monomers, oligomers, prepolymers, and polymers, with or without adding reinforcing filler. One type of silicone material that is suitable can incorporate at least 1 alkenyl group having at least 2 carbon atoms in their molecules. Examples of these alkenyl groups include, but are not limited to, vinyl, allyl, butenyl, pentenyl, hexenyl, and decenyl. The alkenyl functionality can be located at any location of the silicone structure, including one or both terminals of the structure. The remaining (i.e., non-alkenyl) silicon-bonded organic groups in this component are independently selected from hydrocarbon or halogenated hydrocarbon groups that contain no aliphatic unsaturation. Non-limiting examples of these include: alkyl groups, such as methyl, ethyl, propyl, butyl, pentyl, and hexyl; cycloalkyl groups, such as cyclohexyl and cycloheptyl; aryl groups, such as phenyl, tolyl, and xylyl; aralkyl groups, such as benzyl and phenethyl; and halogenated alkyl groups, such as 3,3,3-trifluoropropyl and chloromethyl. Another type of suitable silicone material is one having hydrocarbon groups that lack aliphatic unsaturation. Specific examples include: trimethylsiloxy-endblocked dimethylsiloxane-methylhexenylsiloxane copolymers; dimethylhexenylsiloxy-endblocked dimethylsiloxane-methylhexenylsiloxane copolymers; trimethylsiloxy-endblocked dimethylsiloxane-methylvinylsiloxane copolymers; trimethylsiloxyl-endblocked methylphenylsiloxane-dimethylsiloxane-methylvinysiloxane copolymers; dimethylvinylsiloxy-endblocked dimethylpolysiloxanes; dimethylvinylsiloxy-endblocked dimethylsiloxane-methylvinylsiloxane copolymers; dimethylvinylsiloxy-endblocked methylphenylpolysiloxanes; dimethylvinylsiloxy-endblocked methylphenylsiloxane-dimethylsiloxane-methylvinylsiloxane copolymers; and the copolymers listed above wherein at least one group is dimethylhydroxysiloxy. Examples of commercially available silicones suitable for blending with compositions disclosed herein include Silastic® silicone rubber, commercially available from Dow Corning Corporation of Midland, Mich.; Blensil® silicone rubber, commercially available from General Electric Company of Waterford, N.Y.; and Elastosil® silicones, commercially available from Wacker Chemie AG of Germany.

Other types of copolymers can also be added to the golf ball compositions disclosed herein. For example, suitable copolymers comprising epoxy monomers include styrene-butadiene-styrene block copolymers in which the polybutadiene block contains an epoxy group, and styrene-isoprene-styrene block copolymers in which the polyisoprene block contains epoxy. Examples of commercially available epoxy functionalized copolymers include ESBS A1005, ESBS A1010, ESBS A1020, ESBS AT018, and ESBS AT019 epoxidized styrene-butadiene-styrene block copolymers, commercially available from Daicel Chemical Industries, Ltd. of Japan.

Ionomeric cover compositions can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, plyethylene-(meth)acrylic acid, functionalized polymers with maleic anhydride grafting, Fusabond® functionalized olefins commercially available from E. I. du Pont de Nemours and Company, functionalized polymers with epoxidation, elastomers (e.g., ethylene propylene diene monomer rubber, metallocene-catalyzed polyolefin) and ground powders of thermoset elastomers.

Also suitable for forming the inner and outer core layers are the compositions having high COR when formed into solid spheres disclosed in U.S. Patent Application Publication No. 2003/0130434 and U.S. Pat. No. 6,653,382, the entire disclosures of which are hereby incorporated herein by reference. Reference is also made to U.S. Patent Application Publication No. 2003/0144087 for various ball constructions and materials that can be used in golf ball core, intermediate, and cover layers.

In addition to the above materials, the inner core layer can be formed from a low deformation material selected from metal, rigid plastics, polymers reinforced with high strength organic or inorganic fillers or fibers, and blends and composites thereof. Suitable low deformation materials also include those disclosed in U.S. Patent Application Publication No. 2005/0250600, the entire disclosure of which is hereby incorporated herein by reference.

Compositions disclosed herein can be either foamed or filled with density adjusting materials to provide desirable golf ball performance characteristics.

PROPHETIC EXAMPLE

It should be understood that the examples below are for illustrative purposes only. In no manner is the present invention limited to the specific disclosures herein.

An inner core formulation is prepared by mixing the components in a Brabender mixer for 5-10 minutes. The type and relative amount of each component to be used is indicated in Table 2 below. The resulting composition is cured in a compression molding press at 350° F. for 11 minutes to obtain spheres, which are subsequently ground to a diameter of 1.00 inch.

Outer core formulations are prepared by mixing the components in a Brabender mixer for 5-10 minutes. The type and relative amount of each component to be used is indicated in Table 2 below. The resulting composition is compression molded into half-shells in a compression molding press at 150° F. for 5 minutes. Dual cores are then formed by compression molding two of the half shells around an inner core sphere in a compression molding press at an increasing temperature beginning at 200° F. and reaching 350° F. for a total time of 15 minutes. The resulting dual cores are subsequently ground to a diameter of 1.550 inches.

Each of the dual cores is evaluated for hardness at the center and at the outer surface of the outer core layer. Expected results for hardness are reported in Table 2 below.

TABLE 2

| | Example 1 | Example 2 |
|---|---|---|
| **Inner Core Composition** | | |
| Buna CB 23[1] (parts by weight) | 85 | 85 |
| SE BR-1220L[2] (parts by weight) | 15 | 15 |
| SR526[3] (parts by weight) | 23 | 23 |
| regrind (parts by weight) | 23 | 23 |
| zinc oxide (parts by weight) | 5 | 5 |
| $BaSO_4$ (parts by weight) | 16.8 | 16.8 |
| Perkadox ® BC[4] (parts by weight) | 1 | 1 |
| zinc pentachlorothiophenol (parts by weight) | 0.5 | 0.5 |
| **Outer Core Composition** | | |
| Buna CB 23[1] (parts by weight) | 91 | 91 |
| TP301 transpolyisoprene[5] (parts by weight) | 9 | 9 |
| SR526[3] (parts by weight) | 36 | 45 |
| regrind (parts by weight) | 19.4 | 19.4 |
| zinc oxide (parts by weight) | * | * |
| Perkadox ® BC[4] (parts by weight) | 0.6 | 2.0 |
| zinc pentachlorothiophenol (parts by weight) | 0.5 | 0.5 |
| catechol (parts by weight) | 0 | 0.5 |
| **Hardness** | | |
| outer core surface hardness (Shore C) | 89 | 93 |
| center hardness (Shore C) | 55 | 55 |

[1]Buna CB 23 is a neodymium catalyzed polybutadiene rubber commercially available from Lanxess Corporation.
[2]SE BR-1220L is a cobalt catalyzed polybutadiene rubber commercially available from The Dow Chemical Company.
[3]SR526 is a zinc diacrylate coagent commercially available from Sartomer Industries, Inc.
[4]Perkadox ® BC is a peroxide free radical initiator commercially available from Akzo Nobel.
[5]TP301 is a transpolyisoprene rubber commercially available from Kuraray Co., Ltd.
* The amount of zinc oxide used is adjusted to reach a specific gravity of 1.132.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising:

a core comprising an inner core layer and an outer core layer; and a cover comprising an inner cover layer and an outer cover layer;

wherein the inner core layer is formed from a rubber composition comprising a base rubber and a catechol; and wherein the inner core layer has a positive hardness gradient wherein the difference between the Shore C hardness of the outer surface of the inner core layer ($H_{INNER\ CORE\ OUTER\ SURFACE}$) and the Shore C hardness of the center of the inner core layer ($H_{CENTER}$)≧5 Shore C units; and wherein the surface hardness of the outer core layer is greater than the material hardness of the inner cover layer.

2. The golf ball of claim 1, wherein $H_{INNER\ CORE\ OUTER\ SURFACE}-H_{CENTER}$ ≧10 Shore C units.

3. The golf ball of claim 1, wherein $H_{INNER\ CORE\ OUTER\ SURFACE}-H_{CENTER}$ ≧15 Shore C units.

4. The golf ball of claim 1, wherein $H_{INNER\ CORE\ OUTER\ SURFACE}-H_{CENTER}$ ≧20 Shore C units.

5. The golf ball of claim 1, wherein $H_{INNER\ CORE\ OUTER\ SURFACE}-H_{CENTER}$ ≧25 Shore C units.

6. The golf ball of claim 1, wherein the core comprises an additional outer core layer.

7. A golf ball comprising:

a core consisting of an inner core layer and an outer core layer; and a cover comprising an inner cover layer and an outer cover layer;

wherein the outer core layer is formed from a rubber composition comprising a base rubber and a catechol; and wherein the outer core layer has a positive hardness gradient wherein the difference between the Shore C hardness of the outer surface of the outer core layer ($H_{OUTER\ SURFACE}$) and the Shore C hardness of the inner surface of the outer core layer ($H_{OUTER\ CORE\ INNER\ SURFACE}$)≧5 Shore C units; and wherein the surface hardness of the outer core layer is greater than the material hardness of the inner cover layer.

8. The golf ball of claim 7, wherein $H_{OUTER\ SURFACE}-H_{OUTER\ CORE\ INNER\ SURFACE}$≧10 Shore C units

9. The golf ball of claim 7, wherein $H_{OUTER\ SURFACE}-H_{OUTER\ CORE\ INNER\ SURFACE}$≧15 Shore C units.

10. The golf ball of claim 7, wherein $H_{OUTER\ SURFACE}-H_{OUTER\ CORE\ INNER\ SURFACE}$≧20 Shore C units.

11. A golf ball comprising:

a core comprising an inner core layer, a first outer core layer, and a second outer core layer; and a cover comprising an inner cover layer and an outer cover layer;

wherein at least one of the first and second outer core layers is formed from a rubber composition comprising a base rubber and a catechol; and wherein the outer core layer formed from the rubber composition comprising the catechol has a positive hardness gradient wherein the difference between the Shore C hardness of the outer surface of the outer core layer ($H_{OUTER\ SURFACE}$) and the Shore C hardness of the inner surface of the outer core layer ($H_{OUTER\ CORE\ INNER\ SURFACE}$) ≧5 Shore C units; and wherein the surface hardness of the second outer core layer is greater than the material hardness of the inner cover layer.

12. The golf ball of claim 11, wherein $H_{OUTER\ SURFACE}-H_{OUTER\ CORE\ INNER\ SURFACE}$ ≧10 Shore C units

13. The golf ball of claim 11, wherein $H_{OUTER\ SURFACE}-H_{OUTER\ CORE\ INNER\ SURFACE}$ ≧15 Shore C units.

14. The golf ball of claim 11, wherein $H_{OUTER\ SURFACE}-H_{OUTER\ CORE\ INNER\ SURFACE}$ ≧20 Shore C units.

* * * * *